US005188364A

United States Patent [19]

Falzarano

[11] Patent Number: 5,188,364

[45] Date of Patent: Feb. 23, 1993

[54] AMUSEMENT GAME

[76] Inventor: Carmine L. Falzarano, 8 6th Ave., Atwater, Calif. 95301

[21] Appl. No.: 890,859

[22] Filed: Jun. 1, 1992

[51] Int. Cl.[5] ..... A63F 3/00

[52] U.S. Cl. ..... 273/126 R; 273/275; 273/287; 273/288

[58] Field of Search ..... 273/126 R, 126 A, 236, 273/275, 276, 282, 283, 284, 287, 288

[56] References Cited

U.S. PATENT DOCUMENTS 3,309,092 3/1967 Hardesty et al. ..... 273/275 X
3,843,131 10/1974 Stubbmann ..... 273/248
4,288,076 9/1981 Oyague et al. ..... 273/126 R
4,466,615 8/1984 Yaeger ..... 273/275 X
4,526,376 7/1985 Rosenwinkel et al. ..... 273/249
5,018,743 5/1991 Maier et al. ..... 273/275 X

*Primary Examiner*—Benjamin H. Layno
*Assistant Examiner*—Raleigh W. Chiu
*Attorney, Agent, or Firm*—Leon Gilden

[57] ABSTRACT

An amusement game is formed with a serpentine path formed of various segments. The segments include various hazards, wherein locomotion tool structure is arranged to direct token discs along various top surfaces of the segments, whereupon displacement of the predetermined top surfaces of the discs relative to the top surfaces effects repositioning of the discs to starting the path anew.

10 Claims, 6 Drawing Sheets

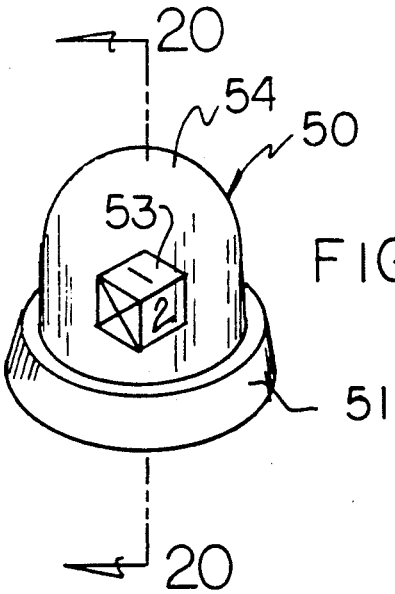
FIG 19
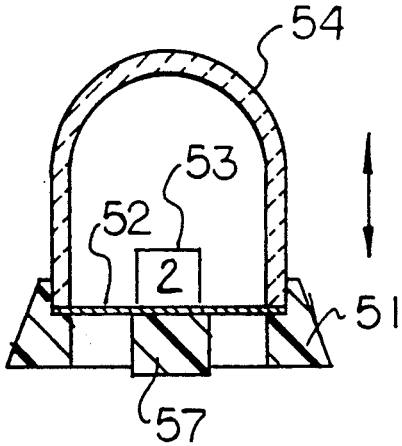
FIG 20
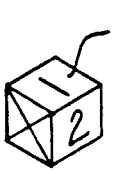
FIG 21
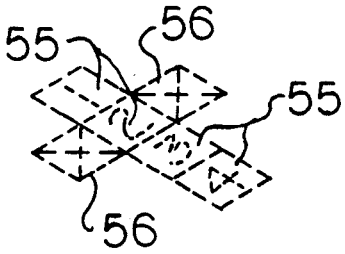
FIG 23
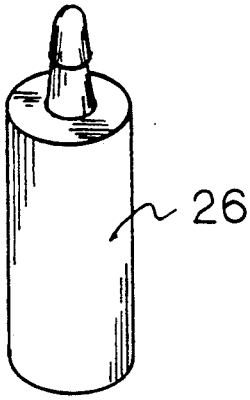
FIG 24
FIG 25
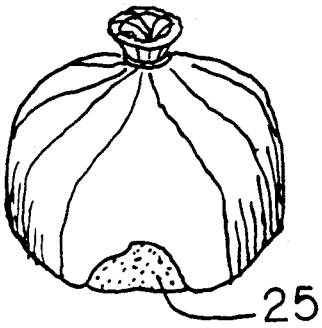
FIG 26
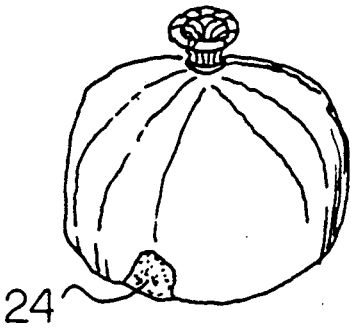

AMUSEMENT GAME

BACKGROUND OF THE INVENTION

1. Field of the Invention

The field of invention relates to amusement game structure, and more particularly pertains to a new and improved amusement game wherein the same is arranged for the amusement and entertainment of individuals attempting to direct various tokens along a predetermined path.

2. Description of the Prior Art

Amusement games of various types are utilized throughout the prior art, with the amusement games having various elements of chance and path structure to direct tokens therealong in a manner as indicated in the U.S. Pat. Nos. 4,878,675; 4,955,617; 4,927,145; 4,890,843; and 4,913,440.

Accordingly, it may be appreciated that there continues to be a need for a new and improved amusement game as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of amusement games now present in the prior art, the present invention provides an amusement game wherein the same is arranged to direct various discs along a path directing discs to begin the path anew upon inadvertent displacement of a token disc relative to predetermined top surfaces of the path. As such, the general purpose of the present invention, which will be described subsequently in greater detail, is to provide a new and improved amusement game which has all the advantages of the prior art amusement games and none of the disadvantages.

To attain this, the present invention provides an amusement game formed with a serpentine path formed of various segments. The segments include various hazards, wherein locomotion tool structure is arranged to direct token discs along various top surfaces of the segments, whereupon displacement of the predetermined top surfaces of the discs relative to the top surfaces effects repositioning of the discs to starting the path anew.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved amusement game which has all the advantages of the prior art amusement games and none of the disadvantages.

It is another object of the present invention to provide a new and improved amusement game which may be easily and efficiently manufactured and marketed.

It is a further object of the present invention to provide a new and improved amusement game which is of a durable and reliable construction.

An even further object of the present invention is to provide a new and improved amusement game which is susceptible of a low cost of manufacture with regard to both materials and labor, and which accordingly is then susceptible of low prices of sale to the consuming public, thereby making such amusement game economically available to the buying public.

Still yet another object of the present invention is to provide a new and improved amusement game which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 19 is an isometric illustration of the token advance device utilized by the invention.

FIG. 20 is an orthographic view, taken along the lines 20—20 of FIG. 19 in the direction indicated by the arrows.

FIG. 21 is an isometric illustration of the die member utilized by the invention.

FIG. 23 is an isometric illustration exemplary of the token die layout.

FIG. 24 is a fluid dispenser utilized by the invention.

FIGS. 25 and 26 are isometric illustrations of bag members maintaining a reservoir of sand particles for obstruction for use With the pit hazard first segment of FIG. 1.

DESCRIPTION OF THE PREFERRED EMBODIMENT

Figure 1:
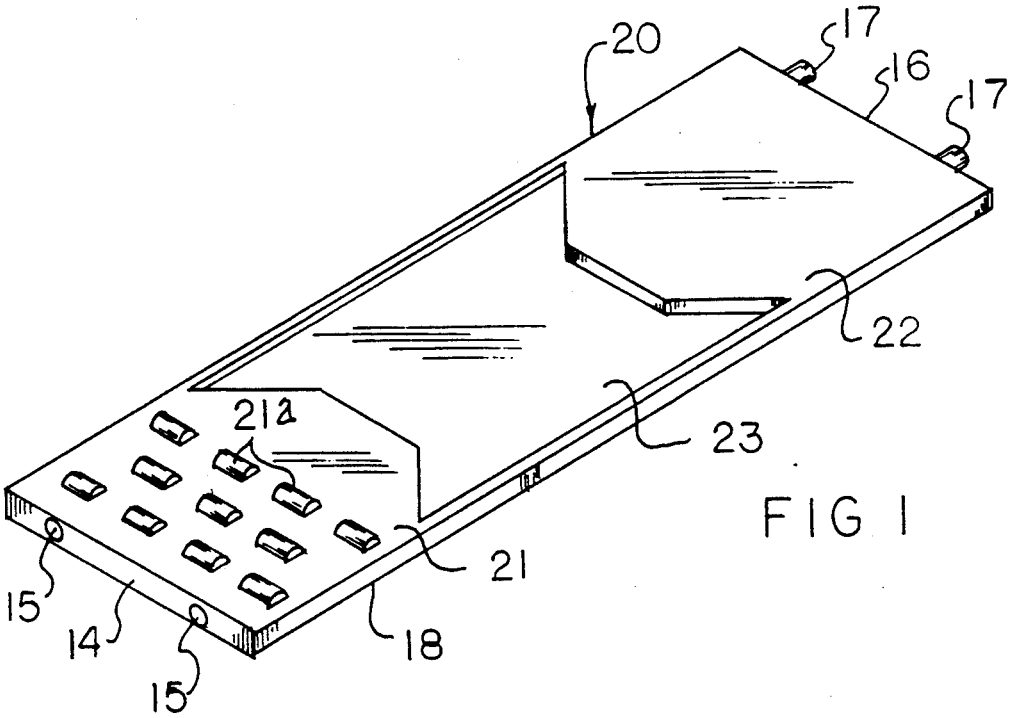
FIG. 1 is an isometric illustration of a pit hazard first category of segments utilized by the invention.

With reference now to the drawings, and in particular to FIGS. 1 to 26 thereof, a new and improved amusement game embodying the principles and concepts of the present invention and generally designated by the reference numerals 11-57 will be described.

Figure 2:
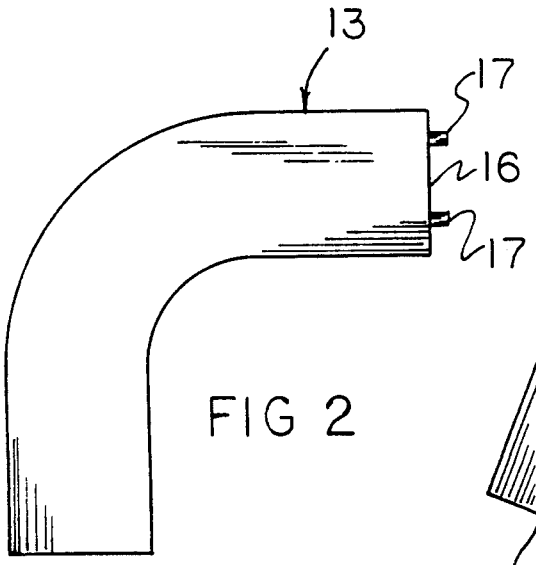
FIG. 2 is an orthographic top view of a second arcuate path segment utilized by the invention.
Figure 4:
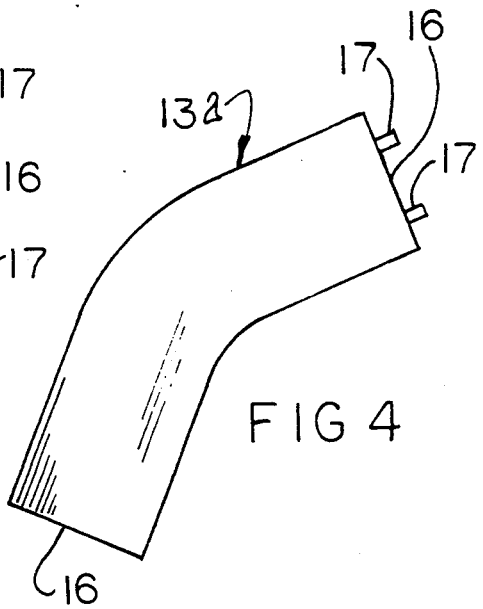
FIG. 4 is an orthographic top view of a second arcuate segment of an oblique angular configuration.
Figure 3:
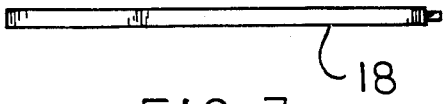
FIG. 3 is an orthographic end view of the segment as set forth in FIG. 2.
Figure 5:
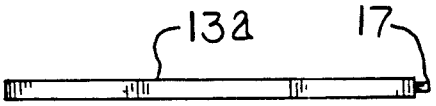
FIG. 5 is an orthographic end view of the segment of FIG. 4.
Figure 6:
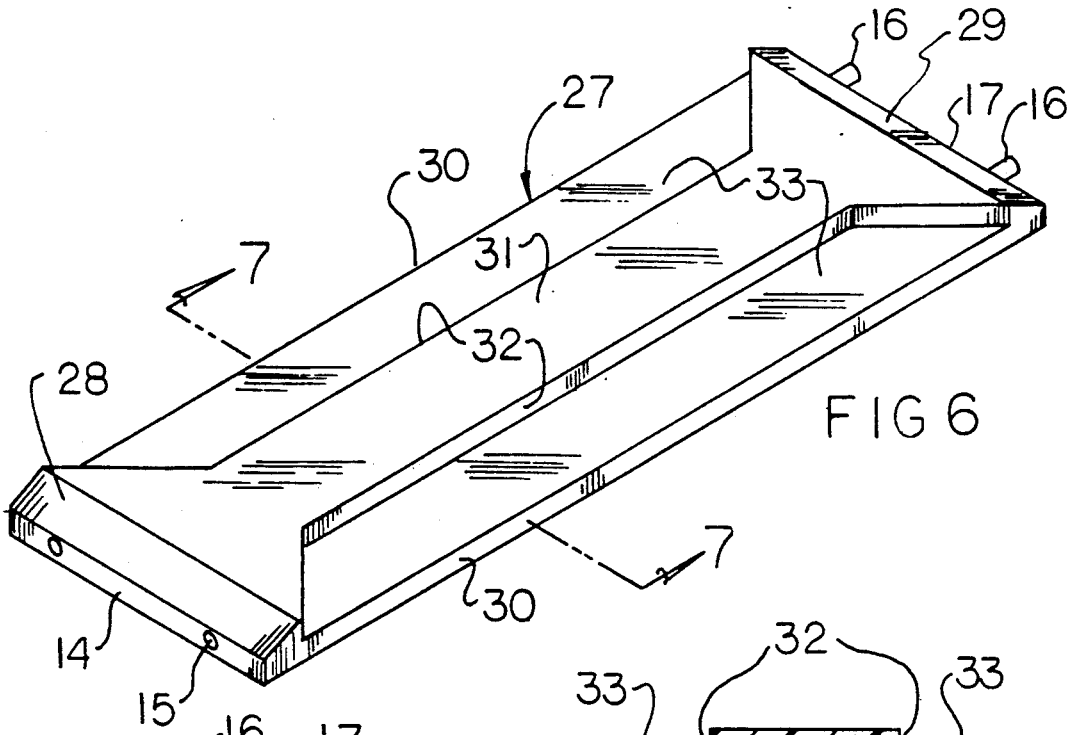
FIG. 6 is an isometric illustration of a clip hazard first segment member.
Figure 7:
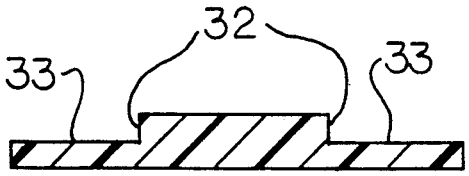
FIG. 7 is an orthographic view, taken along the lines 7—7 of FIG. 6 in the direction indicated by the arrows.
Figure 9:
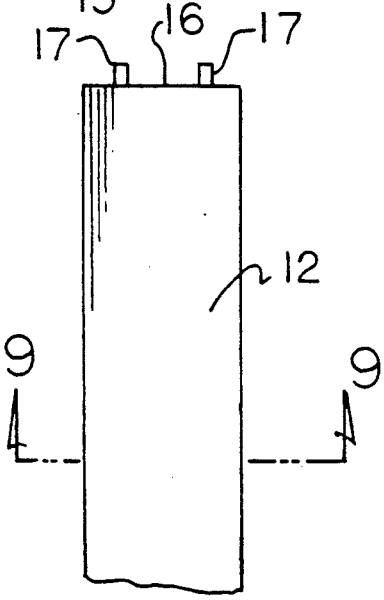
FIG. 9 is an orthographic view, taken along the lines 9—9 of FIG. 8 in the direction indicated by the arrows.
Figure 9:
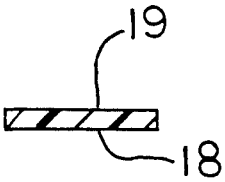
Figure 10:
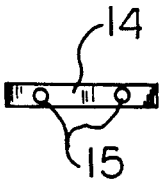
FIG. 10 is an orthographic view, taken along the lines 10—10 of FIG. 8 in the direction indicated by the arrows.
Figure 8:
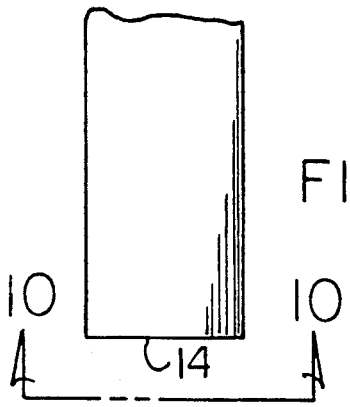
FIG. 8 is an orthographic top view of a first category of segments with a planar top surface.
Figure 11:
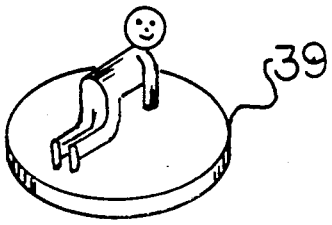
FIG. 11 is an isometric illustration of a token disc utilized by the invention.
Figure 12:
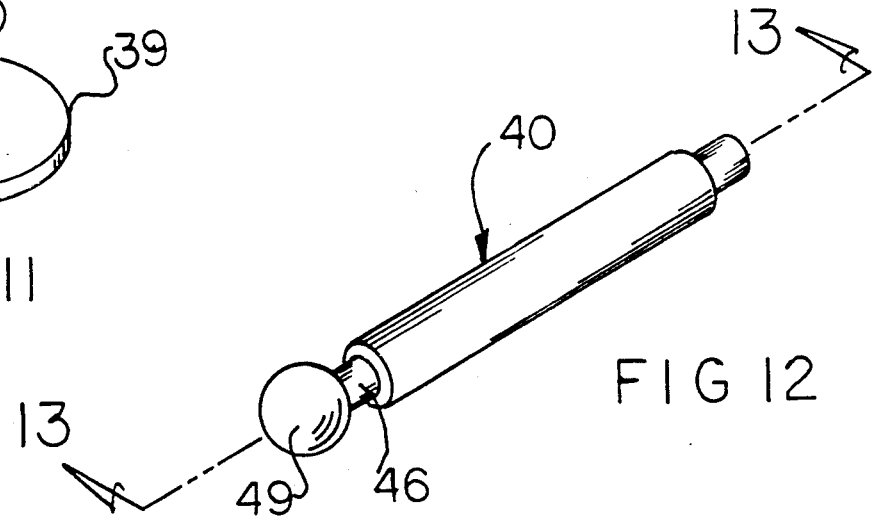
FIG. 12 is an isometric illustration of a locomotion tool utilized by the invention.
Figure 13:
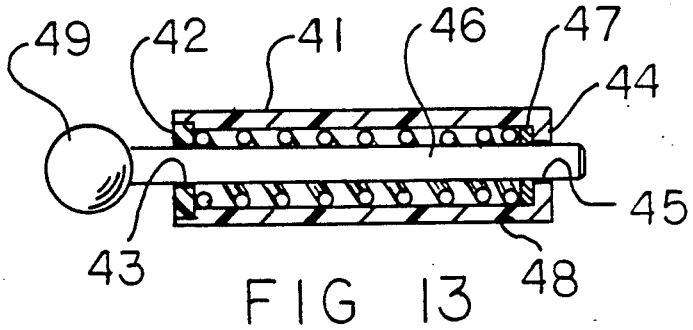
FIG. 13 is an orthographic view, taken along the lines 13—13 of FIG. 12 in the direction indicated by the arrows.
Figure 14:
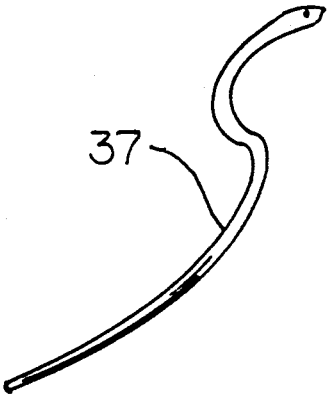
FIGS. 14 and 15 are isometric illustrations of serpentine obstructions utilized by the invention for positioning within the pit hazard member, as indicated in FIG. 1.
Figure 15:
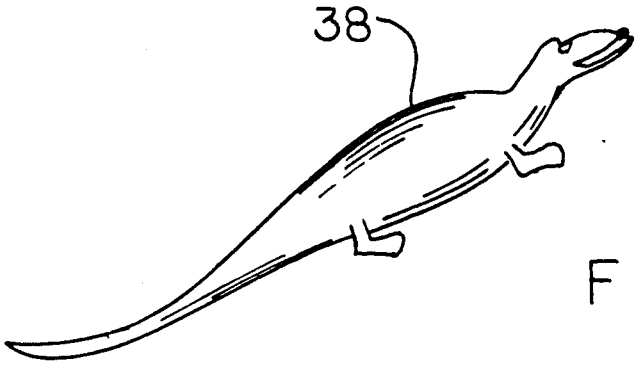
Figure 16:
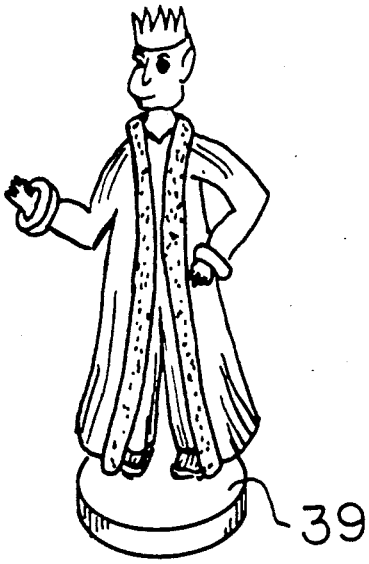
FIGS. 16 and 17 are isometric illustrations of further examples of tokens utilized by the invention.
Figure 17:
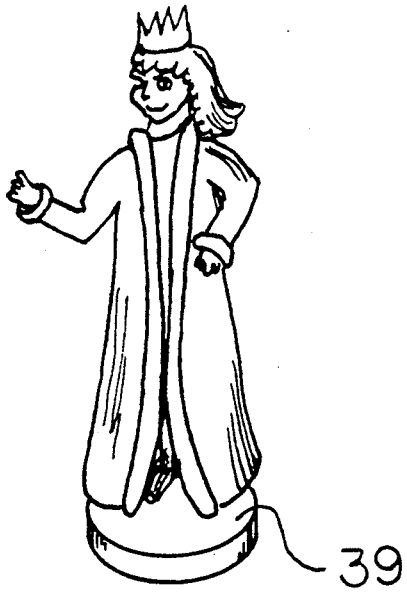
Figure 18:
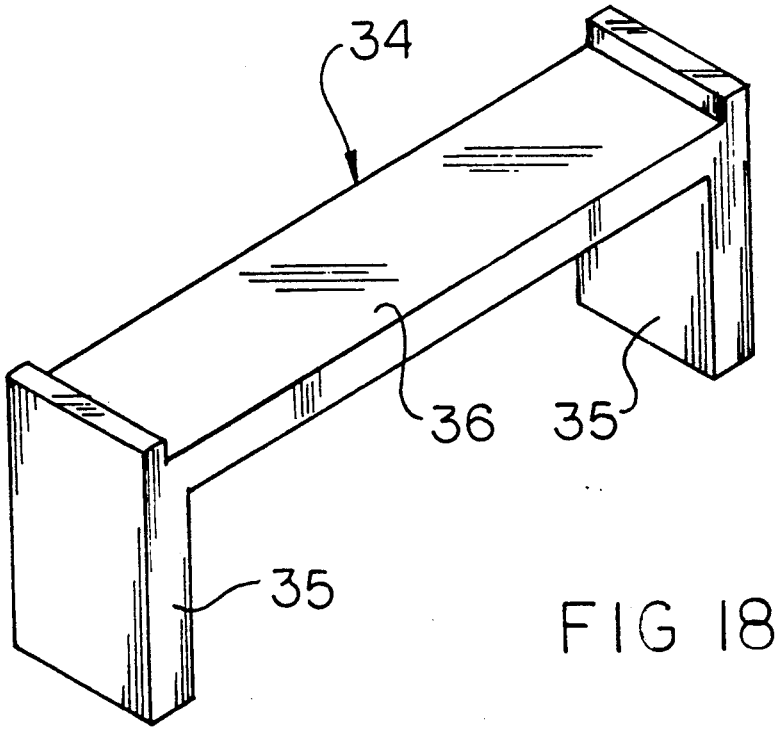
FIG. 18 is an isometric illustration of a bridge member utilized by the invention.

More specifically, the amusement game of the invention essentially comprises a serpentine game path 11 (see FIG. 22) formed of various first and second categories of segments 12 and 13. The first segments are of rectilinear configuration, with the second category of segments of arcuate configuration. The second segments may be of ninety degree configuration, as illustrated in FIG. 2, or of a further arcuate configuration 13*a* of oblique angular configuration, as illustrated in FIG. 4. Each segment includes a first segment end 14 and a second segment end 16. The first segment end 14 includes a plurality of spaced parallel bores 15 spaced apart a predetermined spacing (see FIG. 6), with the second segment end 16 having parallel projections spaced apart the predetermined spacing, with the parallel projections 17 arranged for reception within the parallel bores 15 to provide for interlocking of the segments together at discretionary intermixing relationships of the segments to define various configurations of serpentine paths. It should be noted that each of the segments includes a planar bottom surface 18, as indicated in FIG. 9 for example, wherein certain of the first category of segments 12 include a planar top surface 19 free of obstructions.

Rectilinear segments 12 may be further arranged as configured by the pit hazard first segment 20 (see FIG. 1) having a first planar top surface 21 spaced from and coplanar relative to a second planar top surface 22 that extend from respective first and second segment ends 14 and 16 spaced apart to define a central cavity 23 therebetween enclosed by side walls of the pit hazard segment 20 and the first and second planar top surfaces 21 and 22. In the central cavity 23, various first and second sand colorations 24 and 25 may be positioned from respective first and second containers having the first and second sand colorations 24 and 25. Arranged for injection into the sand 24 and 25 is a fluid 26 dispensed from associated fluid dispensing container, as indicated in FIG. 24. In this manner, the cavity 23 is filled with such sand and optionally, fluid mixture, to impede motion of the token discs 39 (see FIGS. 11, 16 and 17) that are projected across the top surfaces of the pit hazard first segments 20 utilized in the serpentine game path 11. In this manner, sand alone or sand mixture may be utilized. Further, ferromagnetic semi-cylindrical obstructions 21*a* are arranged for mounting upon the first planar top surface 21 as obstructions to the token discs to be directed across the pit hazard first segment 20. In this manner, the magnetic disc having planar bottom surfaces formed of a ferromagnetic material are selectively adhered to the ferrous first planar top surfaces 21.

A plurality of cliff hazard first segments 27 (see FIG. 6) are provided having a canted entrance and exit surface 28 and 29 directed upwardly of the respective first and second ends 14 and 16 of each segment. A central path 31 extends between the entrance and exit surfaces 28 and 29 in communication therewith, with the cliff hazard segments 27 having side walls 30 spaced below path side walls 32 of the central path 31. The central path 31 therefore is elevated between planar recess support surfaces 33 positioned on opposed sides of the central path 31 between the path side walls 32 and the cliff segment side walls 30. A token falling from the central path onto the recess support surfaces 33 is forced to begin anew the serpentine path 11 of the game. Further it should be noted that tokens falling from the path 11 are also required to begin anew. The various obstructions along the pit hazard segments 20 and the like retard progress therealong of the tokens 39.

Figure 22:
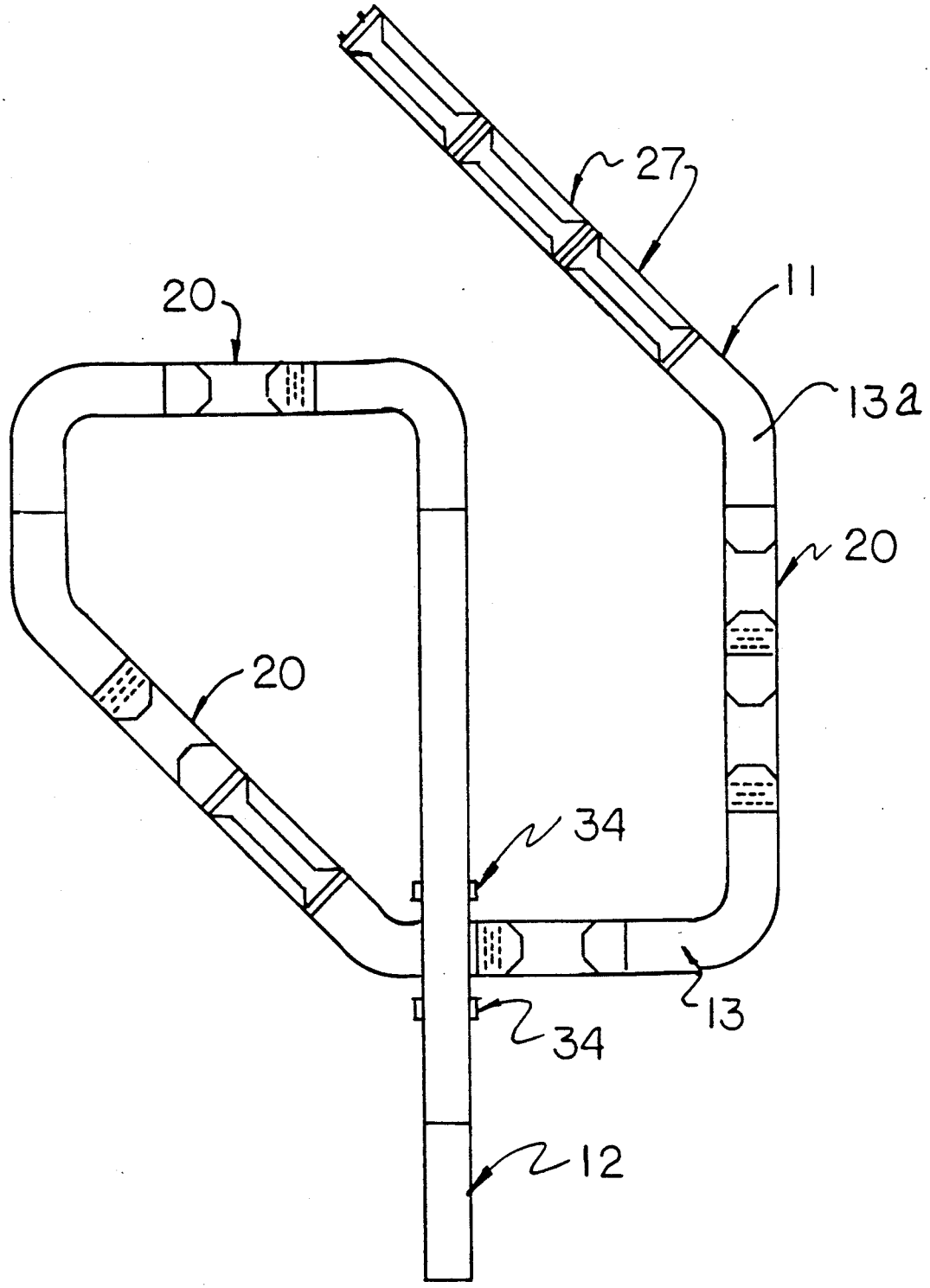
FIG. 22 is an orthographic top view of the game path of the invention.

Further, bridge members 30 are provided having parallel leg plates 35 orthogonally supporting a support plate 36 therebetween that is positioned below upper distal ends of the leg plates 35 to support individual rectilinear or arcuate path segments 12 and 13 in an elevated configuration, as illustrated in FIG. 22. Further, serpentine first and second obstructions 37 and 38 may also be provided for positioning within the central cavity 23 of the pit hazard 20 as further obstruction to game tokens.

To effect trajectory and displacement of the tokens along the game path 11, a locomotion tool 40 (see FIGS. 12 and 13) is provided. The tool 40 includes an outer cylindrical sleeve 41 having parallel rear and front walls 42 and 44 orthogonally oriented relative to the axis of the sleeve 41. A rear wall bore 43 is coaxially aligned with a front wall bore 45 slidably mounting an actuator rod 46 therebetween. The actuator rod 46 extends beyond the front wall 44 and beyond the rear wall 42 exteriorly of the sleeve. The actuator rod includes an actuator rod flange 47 within the sleeve biased adjacent an interior surface of the front wall 44 by a spring 48 captured between the flange 48 and an interior surface of the rear wall 42. A handle 49 mounted to a rear distal end of the rod 46 effects ease of manual grasping. In use, the handle 49 is grasped and the actuator rod 46 retracted and released, with the forward distal end of the actuator rod positioned adjacent a token disc 39 to effect its displacement along the path 11. It should be understood that this is the only means of motivation of the token discs along the path. The number of strokes of the rod against the disc is determined by a token advance device 50. The token advance device 50 includes a cylindrical base 51 having a flexible web 52 mounted within the cylindrical base 51, with the cylindrical base formed as a torroidal configuration. The flexible web 52 has a resilient plug 57 mounted medially to a bottom surface thereof projecting below the cylindrical base 51. The flexible web 52 is formed of a shape retentive spring back material, with the die member 53 positioned thereon. A transparent dome 54 is arranged in surrounding relationship over the flexible web 52 containing the die member 53 within the cylindrical base 51 to a top surface of the flexible web 52 Typically, the die member 53 includes a plurality of numeric designations 55, with blank designations 56. The numerical designation achieved indicates the number of attempts a player may strike an associated token disc with the locomotion tool to effect its displacement along the path. A player completing the path first is declared a winner.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. An amusement game, comprising, a serpentine game path, the serpentine game path including a first category of segments and a second category of segments, each segment including a first end and a second end, with each first end including a plurality of parallel bores spaced apart a predetermined spacing, and each second end including a plurality of segment projections spaced apart said predetermined spacing, wherein said segment projections are arranged for reception within adjacent parallel bores, and each first category of segment and each second category of segment include planar bottom surfaces, and each first category of segments are of a rectilinear configuration, and the second category of segments are of a curvilinear configuration, and token discs arranged for positioning upon the game path, and a locomotion tool arranged for impacting the token discs, and a token advance device arranged for effecting a numerical designation for utilization of the locomotion tool against said token discs.

2. A game as set forth in claim 1 wherein the first category of segments includes a pit hazard first segment having a first planar top surface extending from a pit hazard first segment first end and a second planar top surface extending from a pit hazard first segment second end, with the first planar top surface coplanar with the second planar top surface and spaced therefrom having a central cavity directed into the pit hazard first segment between the first planar top surface and the second planar top surface, with the central cavity enclosed.

3. A game as set forth in claim 2 wherein the central cavity includes granular sand material contained therewithin.

4. A game as set forth in claim 3 wherein the granular sand material includes fluid intermixed within the granular sand material.

5. A game as set forth in claim 4 wherein the first planar top surface includes a ferrous metallic top surface and a plurality of ferromagnetic semi-cylindrical obstructions arranged for selective mounting to the first planar top surface.

6. A game as set forth in claim 5 wherein said first category of segments includes at least one cliff hazard first segment, the cliff hazard first segment includes a canted entrance surface extending from a cliff hazard first segment first end, and a canted exit surface extending from a cliff hazard first segment second end, and a central path extending between the canted entrance surface and the canted exit surface in communication with the canted entrance surface and the canted exit surface, and the cliff hazard first segment including spaced side walls and the central path positioned between the first side walls, and the central path including central path side walls spaced above the cliff hazard first segment side walls, with planar recessed support surfaces positioned between the central path side walls and the cliff hazard first segment side walls.

7. A game as set forth in claim 6 including at least one bridge member receiving at least one of said first category of segments thereon, the at least one bridge member includes parallel leg plates, and a support plate orthogonally and integrally mounted between the leg plates spaced below upper distal ends of the leg plates, wherein the support plate receives said at least one of said first category of segments thereon.

8. A game as set forth in claim 7 including at least one serpentine obstruction arranged for positioning upon said central cavity of said pit hazard first segment.

9. A game as set forth in claim 6 wherein said locomotion tool includes an outer cylindrical sleeve, the outer cylindrical sleeve defines along a predetermined axis, and the sleeve including a rear wall spaced from and parallel a front wall, with the rear wall and the front wall orthogonally oriented relative to the axis, the rear wall including a rear wall bore, the front wall including a front wall bore, with the rear wall bore and the front wall bore coaxially aligned, and an actuator rod slidably directed through the rear wall bore and the front wall bore, with the actuator rod extending beyond the front wall and the actuator rod extending exteriorly of the sleeve beyond the rear wall, with a rear distal end of the actuator rod including a handle, the actuator rod including an actuator rod flange fixedly mounted to the actuator rod adjacent the actuator rod front wall, with the actuator rod flange positioned interiorly of the sleeve, and a spring captured between the actuator rod flange and the rear wall whereupon axial displacement of the actuator rod against the spring permits release of the actuator rod to effect projection of the actuator rod from the sleeve, whereupon positioning of a forward distal end of the actuator rod adjacent one of said token discs effects locomotion of said token disc.

10. A game as set forth in claim 5 wherein said token advance device includes a torroidal cylindrical base having a flexible web mounted thereon, with the flexible base formed of a shape retentive spring back material, and a resilient plug mounted to a bottom surface of the flexible web medially thereof, with the plug projecting below the cylindrical base, and a die member mounted on the flexible web to a top surface thereof, and a transparent dome fixedly mounted to the cylindrical base projecting above the die member and the flexible web capturing the die member within the transparent dome, whereupon projection of the token advance device upon a support surface effects projection of the resilient plug into the flexible web to effect displacement of the die member from the flexible web and generating of a random designation by said die member to indicate a game player to utilize said numeric designation in utilization of the locomotion tool in cooperation with one of said token discs.

* * * * *